US009288600B2

(12) United States Patent
Jansson

(10) Patent No.: US 9,288,600 B2
(45) Date of Patent: Mar. 15, 2016

(54) SOUND GENERATOR

(71) Applicant: Daniel Jansson, Shenzhen (CN)

(72) Inventor: Daniel Jansson, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 54 days.

(21) Appl. No.: 14/332,515

(22) Filed: Jul. 16, 2014

(65) Prior Publication Data

US 2015/0023506 A1 Jan. 22, 2015

(30) Foreign Application Priority Data

Jul. 18, 2013 (CN) ..... 2013 1 0302489

(51) Int. Cl.
*H04S 3/00* (2006.01)
*H04R 3/12* (2006.01)

(52) U.S. Cl.
CPC *H04S 3/002* (2013.01); *H04R 3/12* (2013.01); *H04R 2499/15* (2013.01); *H04S 2400/07* (2013.01)

(58) Field of Classification Search
CPC ..... H04S 1/00; H04S 3/002; H04S 2400/07; H04R 3/12; H04R 2499/15; H04R 1/00
USPC ..... 381/17, 308, 27, 334, 335, 342, 351, 381/401
See application file for complete search history.

(56) References Cited

U.S. PATENT DOCUMENTS

| | | | | |
|---|---|---|---|---|
| 6,424,719 | B1 * | 7/2002 | Elko | H04S 1/00 381/1 |
| 7,702,320 | B2 * | 4/2010 | Komura | H04M 1/0202 235/487 |
| 7,957,545 | B2 * | 6/2011 | Kim | H04R 3/14 381/1 |
| 8,260,343 | B2 * | 9/2012 | Eaton | H04M 1/03 379/388.01 |
| 2004/0131202 | A1 * | 7/2004 | Cranfill | H04M 1/035 381/89 |
| 2011/0194712 | A1 * | 8/2011 | Potard | H04S 1/002 381/300 |

* cited by examiner

*Primary Examiner* — Vivian Chin
*Assistant Examiner* — David Ton
(74) *Attorney, Agent, or Firm* — IPro, PLLC; Na Xu

(57) ABSTRACT

A sound generator includes a diaphragm including n sub-diaphragms (n, the amount of the sub-diaphragms); n voice coils corresponding to the sub-diaphragms; a signal source for outputting signals of n channels; n high-pass filters for receiving the signals of n channels and outputting n high frequency signals; n low-pass filters for receiving the signals of n channels and outputting n low frequency signals; a first mixer for mixing the n low frequency signals and then outputting a low frequency signal; and n second mixers for mixing the low frequency signal and the n high frequency signals, and then outputting n driving signals. The n driving signals actuates the n corresponding sub-diaphragms for producing stereo sounds.

6 Claims, 6 Drawing Sheets

SOUND GENERATOR

FIELD OF THE INVENTION

The present invention relates to electroacoustic transducers, and more particularly to a sound generator which enables producing stereo sounds using a miniature speaker.

DESCRIPTION OF RELATED ART

With the rapid development of the mobile internet, smart mobile devices are not only widely used for normal voice communication, but also enjoying multimedia contents. A speaker is a necessary component used in such a smart mobile device, like a mobile phone, for converting electrical signals to audible sounds. Quality of the speaker determines the acoustic performance of the smart mobile device.

For achieving better acoustic performance, a related sound generator generally includes a multi-sound-channel system comprising a plurality of speakers, such as a 2.1 sound channel system, or a 5.1 sound channel system. These speakers are arranged to receive different ranges of frequencies for producing individually sounds corresponding to the different ranges of frequencies. It is no doubt that such a system with a plurality of speakers must occupy too much space of the mobile device, or even increases the volume of the mobile device, which is not desired by the users.

Accordingly, an improved sound generator which can overcome the disadvantage described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
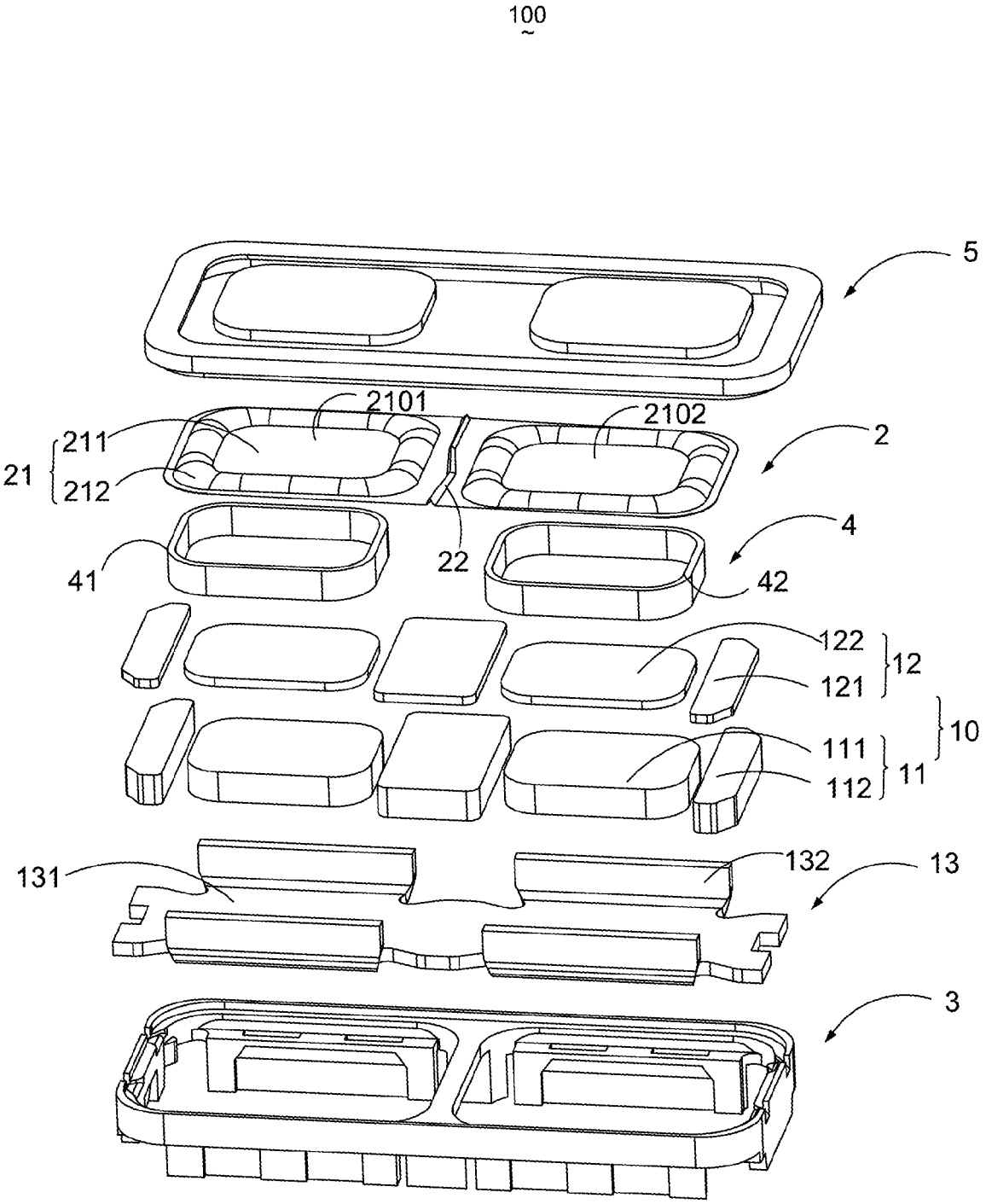
FIG. 1 is an isometric exploded view illustrating a sound generator of the present disclosure.

Referring to FIG. 1, the sound generator 100 of the present disclosure includes a frame 3 having a receiving space, a front cover 5 coupled with the frame 3, at least two magnetic circuit units 10 accommodated in the receiving space of the frame 3, a diaphragm 2 fixed with the frame 3, and a plurality of voice coils 4 connected to the diaphragm 2. The plurality of voice coils 4 are corresponding to the magnetic circuit units 10. In this embodiment, the diaphragm 2 is fixed to the frame 3. In fact, alternatively, the diaphragm 2 can also be fixed to other components, like the magnetic circuit unit. The voice coils 4 may alternatively connected to the diaphragm 2 via a medium.

Each of the magnetic circuits 10 includes a lower plate 13, a magnet assembly 11 mounted on the lower plate 13, and a pole plate assembly 12 attached to a top surface of the magnet assembly 11. The magnet assembly 11 includes a first magnet 111 and a second magnet 112 adjacent to the first magnet 111 for forming a magnetic gap there between. The pole plate assembly 12 includes a first pole plate 122 attached to the first magnet 111, and a second pole plate 121 attached to the second magnet 112. The second magnet 112 may be a ring-shaped structure surrounding the first magnet 111, or be a plurality of magnets surrounding the first magnet 111. The amount of the second magnet is not limited to the description above, and is acceptable as long as it can form a magnetic gap cooperatively with the first magnet. Actually, the magnetic circuit unit provides a magnetic field to interact with the voice coils for producing Lorenz Force, by which the voice coil is activated to force the diaphragm to vibrate. Thus, the magnetic circuit unit may only include one permanent magnet, not a plurality of magnets. A yoke having a sidewall, as disclosed by other prior arts, can be used when only one magnet exists.

In the first embodiment, the lower plates 13 of all the magnetic circuits 10 is formed as an integral one piece part. Furthermore, the lower plate 13 may be a yoke, or a plane for carrying the magnet assembly 11 thereon. In this embodiment, the lower plate 13 includes a bottom 131 and a side wall 132 extending vertically from the bottom 131. The diaphragm 2 includes a plurality of sub-diaphragms 21, a pleat portion 22 for connecting two adjacent sub-diaphragms 21 and a periphery surrounding the plurality of sub-diaphragms 21 and fixed on the frame 3. The pleat portion 22 is capable of preventing signal leakage between the two adjacent sub-diaphragms 21 and performing independent vibration between multiple sub-diaphragms 21. Each of the sub-diaphragms 21 includes a dome 211 and a suspension 212 surrounding and connecting with the dome 211. The amount of the sub-diaphragms 21 is equal to that of the magnetic circuit units 10.

The amount of the voice coils 4 is equal to that of the sub-diaphragms 21. For example, the amount of the voice coils 4 may be 2, or 5, and correspondingly, the amount of the sub-diaphragms 21 may also be 2, or 5. Each of the voice coils 4 includes a distal end suspended in the corresponding magnetic gap. Each of the voice coils 4 is provided with a certain range of frequency, and separately drives the corresponding sub-diaphragm 21 to vibrate for producing sounds corresponding to the certain range of frequency provided thereto. In the current embodiment, the voice coil 4 includes a first voice coil 41 and a second voice coil 42, and correspondingly, the diaphragm 2 includes a first sub-diaphragm 2101 and a second sub-diaphragm 2102.

Figure 2:
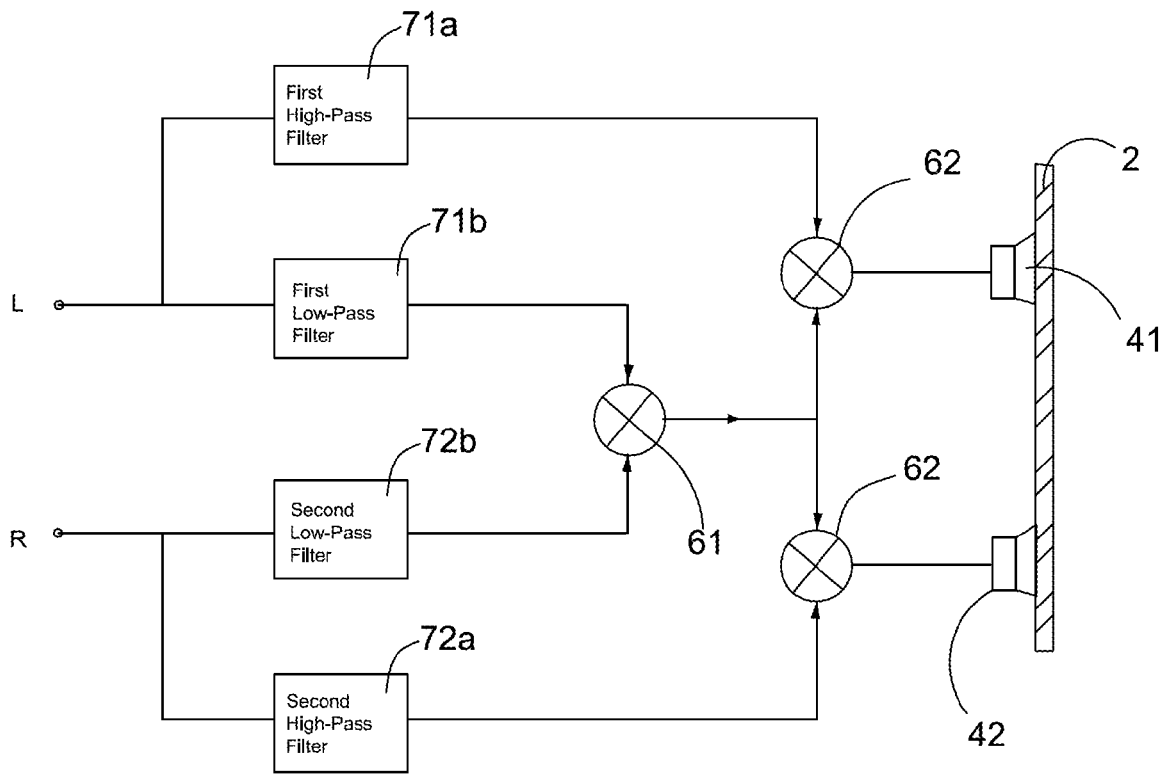
FIG. 2 is an illustrative diagram explaining the principle of the sound generator for producing sounds, in accordance with an embodiment.

Referring to FIG. 2, a detailed embodiment of the present disclosure will be described. The sound generator 100 includes a first high-pass filter 71*a*, a first low-pass filter 71*b*, a second high-pass filter 72*a*, a second low-pass filter 72*b*, and a plurality of mixers. The first low-pass filter 71*b* may be same to the second low-pass filter 72*b*, or not. Again, the first high-pass filter 71*a* may be same to the second high-pass filter 72*a*, or not. The sound generator further includes a signal source for producing a left-channel signal L and a right-channel signal R. The left-channel signal L is converted to a first high frequency signal by the first high-pass filter 71*a*, and is converted to a first low frequency signal by the first low-pass filter 71*b*. Similarly, the right-channel signal R is converted to a second low frequency signal by the second low-pass filter 72*b*, and is converted to a second high frequency signal by the second high-pass filter 72*a*.

The mixers include a first mixer 61 and a pair of second mixers 62. The first mixer 61 is used for receiving and mixing the low frequency signals generated by the first low-pass filter 71*b* and the second low-pass filter 72*b*, and one of the second mixers 62 is used for receiving and mixing the low frequency signals and the high frequency signals. The first low frequency signal and the second low frequency signal are mixed to be a low frequency signal, and said low frequency signal is mixed with the first high frequency signal by the first mixer 61 for forming a first driving signal. Said low frequency signal is mixed with the second high frequency signal by the second mixer 62 for forming a second driving signal. The first driving signal is transmitted to the first voice coil 41 so as to drive the first sub-diaphragm 2101 to vibrate, and the second driving signal is transmitted to the second voice coil 42 so as to drive the second sub-diaphragm 2102 to vibrate. The first driving signal contains the first high frequency signal and the low frequency signals retrieved from the left and right channel signals; and the second driving signal contains the second high frequency signal and the low frequency signals retrieved from the left and right channel signals. The first and second driving signals work individually, which are capable of driving the diaphragm 2 to produce two kinds of high frequency sounds and one low frequency sound, that is, the sound generator realizes a 2.1-channel sound effect, achieves better stereo performance, and improves low frequency response and wideband frequency response.

Figure 3:
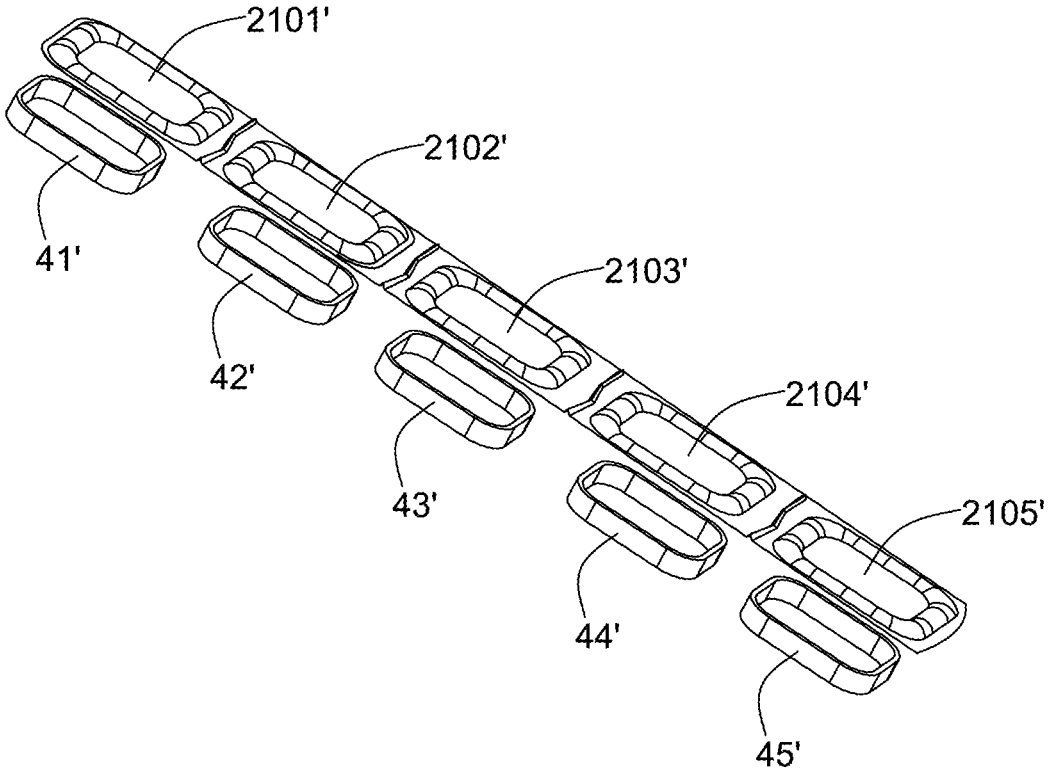
FIG. 3 is an isometric exploded view of a sound generator of another embodiment of the present disclosure, only showing the voice coils and the corresponding sub-diaphragms.
Figure 4:
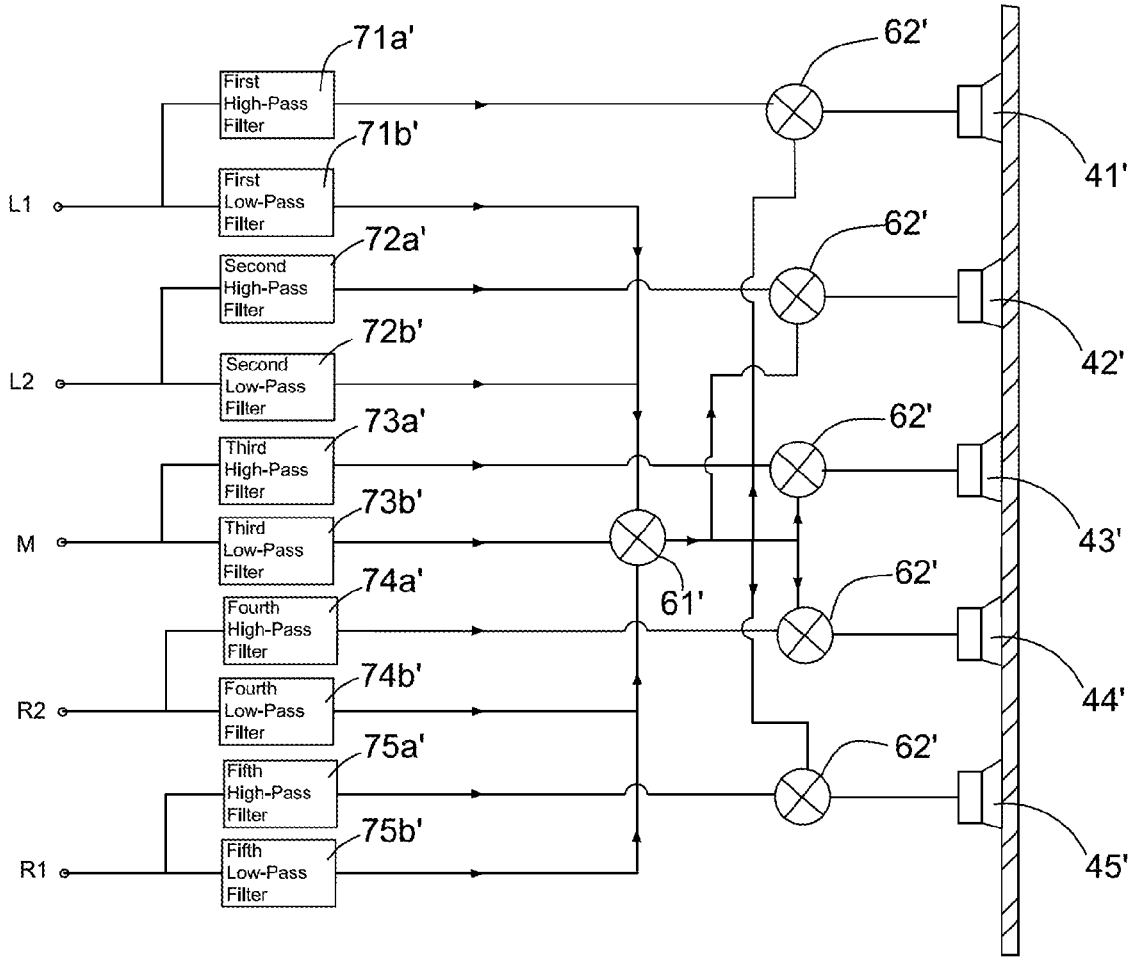
FIG. 4 is an illustrative diagram explaining the principle of the sound generator in FIG. 3.

Referring to FIGS. 3-4, a sound generator of another embodiment enables 5.1-channel system. The sound generator includes five voice coils 4 comprising a first voice coil 41', a second voice coil 42', a third voice coil 43', a fourth voice coil 44', and a fifth voice coil 45'. Correspondingly, the diaphragm 2 includes a first sub-diaphragm 2101', a second sub-diaphragm 2102', a third sub-diaphragm 2103', a fourth sub-diaphragm 2104', and a fifth sub-diaphragm 2105'. Further, the sound generator includes a first high-pass filter 71*a*', a first low-pass filter 71*b*', a second high-pass filter 72*a*', a second low-pass filter 72*b*', a third high-pass filter 73*a*', a third low-pass filter 73*b*', a fourth high-pass filter 74*a*', a fourth low-pass filter 74*b*', a fifth high-pass filter 75*a*', a fifth low-pass filter 75*b*', and a plurality of mixers.

The sound generator also includes a signal source for outputting central-channel signal M, left-front-channel signal L1, right-front-channel signal R1, left-rear-channel signal L2, right-rear-channel signal R2. The left-front-channel signal L1 is converted to a first high frequency signal by the first high-pass filter 71*a*', and is converted a first low frequency signal by the first low-pass filter 71*b*'; the left-rear-channel signal L2 is converted to a second high frequency signal by the second high-pass filter 72*a*', and is converted to a second low frequency signal by the second low-pass filter 72*b*'; the central-channel signal M is converted to a third high frequency signal by the third high-pass filter 73*a*', and is converted to a third low frequency signal by the third low-pass filter 73*b*'; the front-right-channel signal R1 is converted to a fourth high frequency signal by the fourth high-pass filter 74*a*', and is converted to a fourth low frequency signal by the fourth low-pass filter 74*b*'; the right-rear-channel signal R2 is converted to a fifth high frequency signal by the fifth high-pass filter 75*a*', and is converted to a fifth low frequency signal by the fifth low-pass filter 75*b*'.

The mixers includes a first mixer 61' and five second mixers 62'. The first mixer 61' is capable of receiving and mixing the low frequency signals, and the second mixer 62' is capable of receiving and mixing the low frequency signals and the high frequency signals. The first, second, third, fourth, and fifth low frequency signals are mixed to a low frequency signal by the first mixer 61'. Said low frequency signal is respectively mixed with the first, second, third, fourth and fifth high frequency signals for forming a first driving signal, a second driving signal, a third driving signal, a fourth driving signal, and a fifth driving signal by the second mixers 62'. The first driving signal is transmitted to the first voice coil 41' so as to drive the first sub-diaphragm 2101' to vibrate, the second driving signal is transmitted to the second voice coil 42' so as to drive the second sub-diaphragm 2102' to vibrate, the third driving signal is transmitted to the third voice coil 43' so as to drive the third sub-diaphragm 2103' to vibrate, the fourth driving signal is transmitted to the fourth voice coil 44' so as to drive the fourth sub-diaphragm 2104' to vibrate, and the fifth driving signal is transmitted to the fifth voice coil 45' so as to drive the fifth sub-diaphragm 2105' to vibrate. Every single driving signal works individually, which can drive the diaphragm to produce five kinds of high frequency sounds and one low frequency sound, that is, the sound generator realizes a 5.1-channel sound effect, achieves better stereo performance, and improves low frequency response and wideband frequency response.

Figure 5:
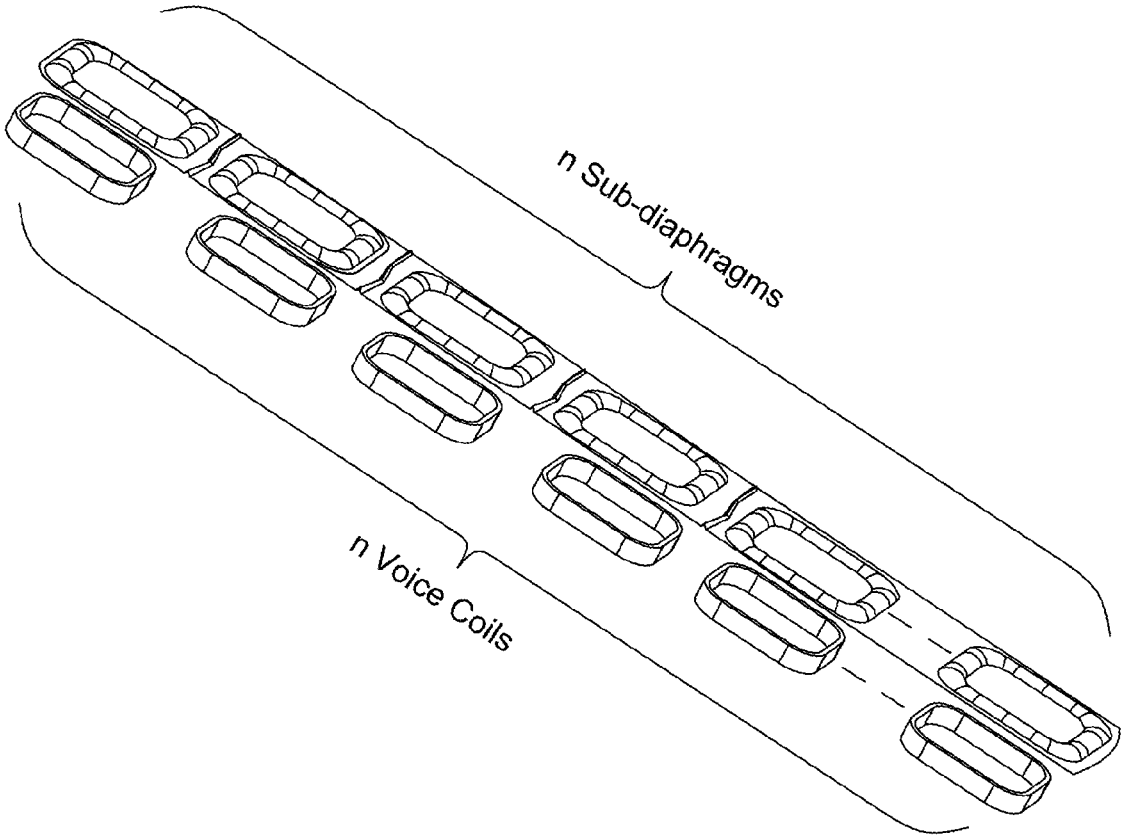
FIG. 5 is an isometric exploded view of a sound generator of another embodiment of the present disclosure, only showing the voice coils and the corresponding sub-diaphragms.
Figure 6:
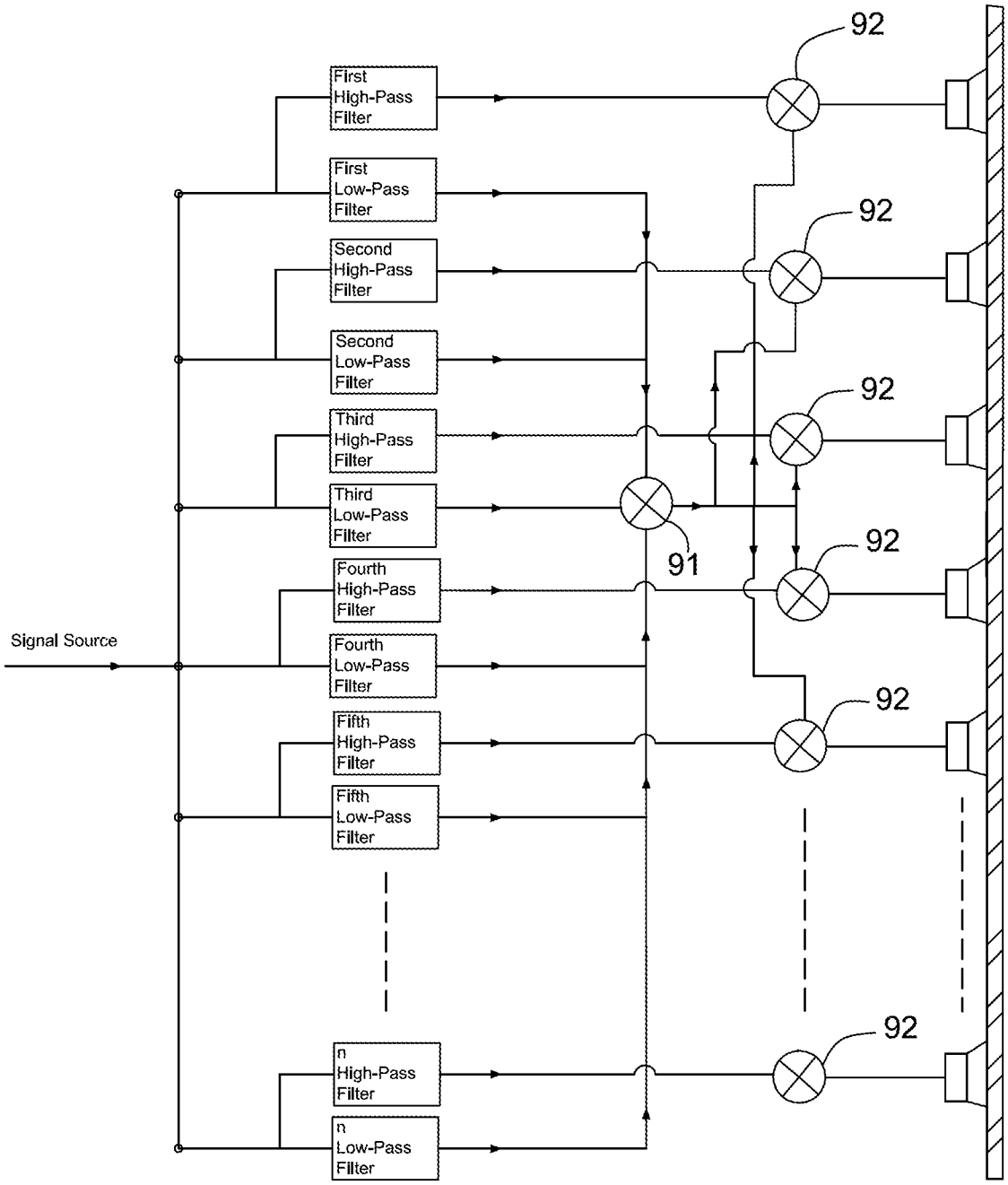
FIG. 6 is an illustrative diagram explaining the principle of the sound generator in FIG. 5.

In fact, the amounts of the voice coils and the sub-diaphragms can be adjustable and shall not be limited to the two embodiments described above. As long as the amount of the voice coils matches the amount of the sub-diaphragms, the diaphragm can be driven to produce corresponding sounds. To put it to simple, referring to FIGS. 5-6, the sound generator includes a diaphragm having n sub-diaphragms (where, n is the amount of the sub-diaphragms), n voice coils corresponding to the sub-diaphragms, and a signal source for outputting signals of n channels. Pleat portions are arranged between two adjacent sub-diaphragms. Further, the sound generator includes n high-pass filters corresponding to the n channels, n low-pass filters, a first mixer 91, and n second mixers 92. The high-pass filters respectively receive the signals of n channels, and output n high frequency signals; and the low-pass filters respectively receive the signals of n channels, and output n low frequency signal. The first mixer is used for mixing n low frequency signals and outputting a low frequency signal. The n second mixers are used for mixing the low frequency signal and the n high frequency signals and outputting n driving signals. The driving signals are transmitted to the corresponding n voice coils so as to drive the n sub-diaphragms to vibrate. By virtue of the pleat portions, the sub-diaphragms can vibrate individually and will not affect the adjacent sub-diaphragm.

The sound generator disclosed herein can also comprise a noise-reduction system for reducing noise and amplifying sound signals so as to achieve better sound performance. The noise-reduction system may be a DNRS (Dolby Noise-Reduction System) solution or a DTS (Digital Theater System) solution.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sound generator, comprising:

a diaphragm having a first sub-diaphragm, and a second sub-diaphragm connected with the first sub-diaphragm;

a voice coil having a first voice coil corresponding to the first sub-diaphragm, and a second voice coil corresponding to the second sub-diaphragm;

a signal source for outputting a left channel signal L and a right channel signal R;

a first high-pass filter for receiving the left channel signal L and outputting a first high frequency signal;

a first low-pass filter for receiving the left channel signal L and outputting a first low frequency signal;

a second high-pass filter for receiving the right channel signal R and outputting a second high frequency signal;

a second low-pass filter for receiving the right channel signal R and outputting a second low frequency signal;

a first mixer for mixing the first low frequency signal and the second low frequency signal, and outputting a low frequency signal;

a pair of second mixers for mixing the low frequency signal and the first high frequency signal for outputting a first driving signal, and mixing the low frequency signal and the second high frequency signal for outputting a second driving signal;

the first driving signal being transmitted to the first voice coil for driving the first sub-diaphragm to vibrate, and the second driving signal being transmitted to the second voice coil for driving the second sub-diaphragm to vibrate.

2. The sound generator as described in claim 1, wherein the diaphragm further comprises a pleat portion for connecting the first sub-diaphragm with the second sub-diaphragm.

3. A sound generator, comprising:

a diaphragm including a first sub-diaphragm, a second sub-diaphragm, a third sub-diaphragm, a fourth sub-diaphragm, and a fifth sub-diaphragm;

a voice coil comprising a first voice coil, a second voice coil, a third voice coil, a fourth voice coil, and a fifth voice coil, respectively corresponding to the sub-diaphragms;

a signal source for outputting central-channel signal M, left-front-channel signal L1, right-front-channel signal R1, left-rear-channel signal L2, right-rear-channel signal R2;

a first high-pass filter for receiving the left-front-channel signal L1 and outputting a first high frequency signal;

a first low-pass filter for receiving the left-front-channel signal L1 and outputting a first low frequency signal;

a second high-pass filter for receiving the left-rear-channel signal L2 and outputting a second high frequency signal;

a second low-pass filter for receiving the left-rear-channel signal L2 and outputting a second low frequency signal;

a third high-pass filter for receiving the central-channel signal M and outputting a third high frequency signal;

a third low-pass filter for receiving the central-channel signal M and outputting a third low frequency signal;

a fourth high-pass filter for receiving the right-front-channel signal R1 and outputting a fourth high frequency signal;

a fourth low-pass filter for receiving the right-front-channel signal R1 and outputting a fourth low frequency signal;

a fifth high-pass filter for receiving the right-rear-channel signal R2 and outputting a fifth high frequency signal;

a fifth low-pass filter for receiving the right-rear-channel signal R2 and outputting a fifth low frequency signal;

a first mixer for mixing the first low frequency signal, the second low frequency signal, the third low frequency signal, the fourth low frequency signal, and the fifth low frequency signal, and then outputting a low frequency signal;

five second mixers for mixing the low frequency signal and the first high frequency signal, the second high frequency signal, the third high frequency signal, the fourth high frequency signal, and the fifth high frequency signal, respectively, and then outputting a first driving signal for actuating the first sub-diaphragm by the first voice coil, a second driving signal for actuating the second sub-diaphragm by the second voice coil, a third driving signal for actuating the third sub-diaphragm by the third voice coil, a fourth driving signal for actuating the fourth sub-diaphragm by the fourth voice coil, and a fifth driving signal for actuating the fifth sub-diaphragm by the fifth voice coil.

4. The sound generator as described in claim 3, wherein the diaphragm further comprises a pleat portion for connecting two adjacent sub-diaphragms.

5. A sound generator, comprising:

a diaphragm including n sub-diaphragms, where n is the amount of the sub-diaphragms, n is an integer, and n is greater or equal to 2;

n voice coils corresponding to the sub-diaphragms, respectively;

a signal source for outputting sound signals of n channels;

n high-pass filters for receiving the sound signals of n channels and outputting n high frequency signals;

n low-pass filters for receiving the signals of n channels and outputting n low frequency signals;

a first mixer for mixing the n low frequency signals and then outputting a low frequency signal;

n second mixers for mixing the low frequency signal and the n high frequency signals, and then outputting n driving signals for actuating n corresponding sub-diaphragms.

6. The sound generator as described in claim 5, wherein the diaphragm further includes a pleat portion for connecting two adjacent sub-diaphragms.

* * * * *